US005124243A

United States Patent [19]

Mochizuki et al.

[11] Patent Number: 5,124,243

[45] Date of Patent: Jun. 23, 1992

[54] LIGHT-SENSITIVE SILVER HALIDE PHOTOGRAPHIC MATERIAL

[75] Inventors: Yoshiharu Mochizuki; Toshihiko Yagi, both of Hino, Japan

[73] Assignee: Konica Corporation, Tokyo, Japan

[21] Appl. No.: 698,237

[22] Filed: May 6, 1991

Related U.S. Application Data

[63] Continuation of Ser. No. 313,623, Feb. 21, 1989, abandoned.

[30] Foreign Application Priority Data

Feb. 26, 1988 [JP] Japan ..... 63-44751

[51] Int. Cl.[5] ..... G03C 1/005

[52] U.S. Cl. ..... 430/567; 430/569

[58] Field of Search ..... 430/567, 569

[56] References Cited

U.S. PATENT DOCUMENTS

| | | | |
|---|---|---|---|
| 4,565,778 | 1/1986 | Miyamoto et al. | 430/567 |
| 4,636,461 | 1/1987 | Becker et al. | 430/567 |
| 4,670,375 | 6/1987 | Michiue et al. | 430/567 |
| 4,692,400 | 9/1987 | Kumashiro et al. | 430/567 |
| 4,945,037 | 7/1990 | Saito | 430/569 |
| 4,963,467 | 10/1990 | Ishikawa et al. | 430/567 |
| 4,983,509 | 1/1991 | Inoue et al. | 430/569 |

FOREIGN PATENT DOCUMENTS

| | | | |
|---|---|---|---|
| 0176325 | 4/1986 | European Pat. Off. . | |
| 0202784 | 11/1986 | European Pat. Off. | 430/567 |

*Primary Examiner*—Charles L. Bowers, Jr.
*Assistant Examiner*—Thomas R. Neville
*Attorney, Agent, or Firm*—Frishauf, Holtz, Goodman & Woodward

[57] ABSTRACT

There is disclosed a light-sensitive silver halide photographic material having at least one silver halide emulsion layer containing silver halide crystal grains which comprises at least one of the silver halide emulsion layer contains silver halide crystal grains which satisfy the following conditions of:

(1) composed substantially of silver iodobromide, (2) having a maximum point of a silver iodide content at 67% or less of a distance from the center of the silver halide grain relative to a distance ($l_0$) from the center of the silver halide grain to the outermost surface thereof, (3) having a minimum point of the silver iodide content at 58% or more of the distance form the center of the silver halide grain relative to $l_0$, (4) substantially monotonously reduced in the silver halide content from the maximum point of the silver halide content to the minimum point thereof, and (5) satisfies the following formula:

$$\frac{l_2 - l_1}{l_0} \times 100 \geqq 20$$

wherein $l_0$ has the same meaning as defined above, $l_1$ represents a distance of the maximum point of the silver halide content from the center of the silver halide grain and $l_2$ represents a distance of the minimum point of the silver halide content from the center of the silver halide grain.

30 Claims, No Drawings

LIGHT-SENSITIVE SILVER HALIDE PHOTOGRAPHIC MATERIAL

This application is a continuation of application Ser. No. 07/313,623, filed Feb. 21, 1989 (abandoned).

BACKGROUND OF THE INVENTION

This invention relates to a light-sensitive silver halide photographic material, more particularly to a light-sensitive silver halide photographic material having high sensitivity and improved pressure fog.

In recent years, there is an increasing demand for higher image quality of light-sensitive silver halide photographic material with higher sensitization of color negative film and smaller formatting, as is well known in the art. In response to these demands, there have been abundantly made studies about core/shell type emulsions having silver iodide phase with high silver iodide content. Particularly, core-shell type silver iodobromide emulsions having high silver iodide content phase of 15 mole % or more internally of grains have attracted attention abruptly for use in color negative film.

In connection with such current demand for higher sensitization, higher image quality formation, a demand for strengthening of pressure characteristics in light-sensitive silver halide photographic material has been increased more than before. Although improvement of pressure characteristic has been investigated in the prior art by various means, the point of view that the method to improve stress resistance of silver halide grain itself is practically more preferable and greater in effect than the method of adding a plasticizer, etc. is prevailing. As the prior art born from such standpoint, there have been known, for example, Japanese Provisional Patent Publications No. 35726/1985, No. 147727/1985 and No. 198324/1985. All of these are core/shell emulsions, containing phases applied with halogen substitution with iodides internally of the grains. The silver halide grains obtained according to these methods are improved in pressure characteristics, but the extent of such improvements cannot be said to be satisfactory.

SUMMARY OF THE INVENTION

An object of the present invention is to provide a light-sensitive silver halide photographic material having high sensitivity and reduced pressure fog.

The above object of the present invention can be accomplished by a light-sensitive silver halide photographic material having at least one silver halide emulsion layer containing silver halide crystal grains which comprises at least one of said silver halide emulsion layer contains silver halide crystal grains which satisfy the following conditions of:

(1) composed substantially of silver iodobromide, (2) having a maximum point of a silver iodide content at 67% or less of a distance from the center of the silver halide grain relative to a distance ($l_0$) from the center of the silver halide grain to the outermost surface thereof, (3) having a minimum point of the silver iodide content at 58% or more of the distance form the center of the silver halide grain relative to $l_0$, (4) substantially monotonously reduced in the silver halide content from the maximum point of the silver halide content to the minimum point thereof, and (5) satisfies the following formula:

$$\frac{l_2 - l_1}{l_0} \times 100 \geqq 20$$

wherein $l_0$ has the same meaning as defined above, $l_1$ represents a distance of the maximum point of the silver halide content from the center of the silver halide grain and $l_2$ represents a distance of the minimum point of the silver halide content from the center of the silver halide grain.

DESCRIPTION OF THE PREFERRED EMBODIMENTS

In the present invention, a center of the silver halide grain means, which is the same as in the method reported by Inoue et al. in Collection of Gists of Lectures, Annual Meeting in 1987, Society of Photography of Japan, pp. 46–48, a center of the circle when drawing a circumscribed circle which becomes minimum to a sectional area or samples in which giving a maximum sectional area or 90% or more thereto when the silver halide crystal grains are made to ultra-thin slice by using microtome after dispersing them in a methacryl resin and solidifying them. In the present invention, a distance ($l_0$) from the center of the silver halide grain to the outermost surface is defined by a distance between the center of the circle and a point crossed to the circumscribed circle of the grain when a line is drawn from the center of the circle to outward. Also, detection of the points in which the silver iodide content becomes maximum or minimum and measurement of a distance $l_1$ and $l_2$ from the center of the circle can be obtained by measuring the silver halide content and a position thereof on the line from the center of the circle to the circumscribed circle of the grain in accordance with the XMA method.

When the above formula of the present invention stands up in any of $l_0$, $l_1$ and $l_2$ which is measured on a line drawn to any direction from the center of the circle to the circumscribed circle, such silver halide grains are defined to belong to the present invention. In the measuring method of the inner structure of the silver halide crystal grains according to the present invention, when the maximum point of the silver iodide content or the minimum point thereof is present with a plural number of points, it should be selected the point far from the center of the circle with respect to the maximum point of the silver iodide content and the point nearer to the center of the circle to the minimum point thereof.

In the present invention, the above silver halide grains of the present invention is preferably contained in the silver halide emulsion layer with an amount of 10% by weight or more, more preferably 50% by weight or more, and most preferably 60 to 100% by weight.

In the embodiment of the present invention, the silver iodide content in the outermost surface layer of the grain as described above is preferably 6 mole % or less.

The silver halide grain according to the present invention has the inner structure as described above, and the inner structure of the silver halide grain in which the silver iodide content is substantially monotonously reduced refers to a structure in which the silver iodide content is reduced linearly from a specific point in which it becomes maximum toward a specific point which is outward than the above point from the center and is minimum in silver iodide content, or along a curve having no maximum or minimum. Further, in the present invention, there is also included a structure in which the silver iodide content is reduced along a curve having one or a plural number of maximum value or minimum value.

In the silver halide grain according to the present invention, inner side than the specific point showing maximum silver iodide content may be the structure in which the silver iodide content is monotonously changed or uniform. The specific point in which the silver iodide content becomes maximum should be present at 67% or less, preferably 58% or less, more preferably 46% or less and most preferably 37% or less of a distance from the center of the silver halide grains relative to a distance from the center of the silver halide grain to the outermost surface thereof.

Also, from the specific point in which the silver halide content is minimum to the outermost surface, the silver halide grain may take optional silver iodide distribution within the range between the maximum silver iodide content and the minimum silver iodide content. The distance $l_2$ of from the center of the grain to the specific point in which the silver iodide content is minimum is 58% or more, preferably 67% or more and more preferably 78% or more relative to $l_0$.

The silver iodide content in the outermost surface layer of the silver halide grain according to the present invention may be 20 mole % or less, preferably 10 mole % or less, most preferably 6 mole % or less, and it may be also 0 mole %.

The average silver iodide content in the whole grains of the silver halide emulsion containing the silver halide grains of the present invention may be preferably 30 mole % or less, more preferably in the range of 1 to 20 mole %, most preferably 3 to 15 mole %.

Also, within the range which does not impair the effect of the present invention, silver chloride can be contained.

In the present invention, the silver iodide content of the silver halide grains and the average silver iodide content can be measured by using the EPMA method (Electron-Probe Micro Analyzer Method).

This method can perform elemental analysis of extremely fine portion better than the X-ray analysis by electron beam excitation in which a sample having emulsion grains well dispersed so as not to contact with each other is prepared and electron beam is irradiated thereon.

According to this method, by determining the characteristic X-ray intensity of silver and iodine radiated from the respective particles, the halogen composition of individual grain can be determined.

When at least 50 grains were measured their silver iodide content according to the EPMA method, it is possible to obtain the average silver iodide content from average thereof.

The emulsion of the present invention should preferably contain particles which are more uniform in iodine content therebetween. It is preferred that when the distribution of iodine content between the grains is measured according to the EPMA method, the relative standard deviation should be 50% or less, further 35% or less, particularly 20% or less.

On the other hand, the silver iodide content in the surface layer of the silver halide emulsion can be measured according to the X-ray photoelectric spectroscopy.

In the X-ray photoelectric spectroscopy, prior to its measurement, the emulsion is pre-treated as described below. First, to about 1 ml of the emulsion is added 10 ml of an aqueous 0.01% by weight pronase solution, and the mixture is stirred at 40° C. for 1 hour to effect gelatin decomposition. Next, the mixture is subjected to centrifugation to sediment the emulsion grains, and after removal of the supernatant, 10 ml of an aqueous pronase solution is added, and again gelatin decomposition is effected under the above conditions. This sample is again subjected to centrifugation, and after removal of the supernatant, 10 ml of distilled water is added to have the emulsion grains redispersed in distilled water, and the dispersion is subjected to centrifugation, followed by removal of the supernatant. This water washing operation is repeated to 3 times, and then the emulsion grains are redispersed in ethanol (working up to this step is performed in a dark room). This is thinly coated on a mirror-surface polished silicon wafer in a dimly-lit room. The sample coated on the silicon wafer is measured by X-ray photoelectric spectroscopy within 24 hours.

For measurement by X-ray photoelectric spectroscopy, Model ESCA/SAM 560 produced by PHI Co. is used as the device. The sample is fixed on a holder slanted by 60°, and after vacuum evacuation in a sample pre-evacuation chamber by use of a turbo molecular pump for 10 minutes, introduced into a measuring chamber. Within 1 minute after introduction of the sample, irradiation of X-ray for excitation (Mg-Kα ray) is initiated, and measurement is immediately initiated.

The measurement is conducted under the conditions of an X-ray source voltage of 15 kV, an X-ray power current of 40 mA and a pulse energy of 50 eV.

For determining the surface halide composition, Ag3d, Br3d and I3d3/2 electrons are detected. For detection of the Ag3d electron, the range from 381 eV to 361 eV of bonding energy is measured once at scan step of 0.2 eV for 100 msec for each step; for detection of the Br3d electron, the range from 79 eV to 59 eV of bonding energy measured 5 times at scan step of 0.2 eV for 100 msec for each step; and for detection of the I3d3/2 electron, the range from 644 eV to 624 eV of bonding energy measured for 40 times at scan step of 0.2 eV for 100 msec for each step. The data were obtained by repeating the above operation twice and integrating the measured values.

For calculation of the composition ratio, the integrated intensity of each peak is used. The integrated intensity of the Ag3d peak is determined in cps eV as the unit with the straight line connecting between the intensity of the energy value obtained by adding 4 eV to the bonding energy at which the Ag3d3/2 peak exhibits the maximum value and the intensity of the energy value at which the Ag3d5/2 peak exhibits the maximum value as the base line; the integrated intensity of the Br3d peak is determined in cps.eV as the unit with the straight line connecting between the energy value obtained by adding 4 eV to the bonding energy at which the Br3d5/2 peak exhibits the maximum value and the intensity of the energy value obtained by detracting 3 eV from the bonding energy at which the Br3d5/2 peak exhibits the maximum value as the base line; and the integrated intensity of the I3d3/2 peak is determined in cps.eV as the unit with the straight line connecting between the intensity of the energy value obtained by adding 4 eV to the bonding energy at which the I3d3/2 peak exhibits the maximum value and the intensity of the energy value obtained by detracting 4 eV from the bonding energy at which I3d3/2 peak exhibits the maximum value as the base line.

When the composition ratio is calculated from the integrated intensities of the respective peaks, the relative sensitivity coefficient method is used, and the composition ratio is given with atomic % as the unit by use of 5.10, 0.81 and 4.592, respectively, as the relative sensitivity coefficients of Ag3d, Br3d and I3d3/2. The I (iodine) mole % is determined by dividing the atomic % value of I by the sum of the atomic % value of Br and the atomic % value of I.

In growing the crystal grains of the silver halide emulsion of the present invention, control of pAg during preparation is extremely important. The pAg during growth of the crystal grains may be preferably 6 to 12.

The pAg during formation of silver halide may be either constant, or varied stepwise or continuously, but when it is varied, it is preferred to elevate the pAg with formation of silver halide grains.

In preparing the silver halide emulsion of the present invention, the stirring condition during preparation is extremely important. As the stirring device, it is preferred to use a stirring device in which a silver salt aqueous solution and a halide aqueous solution are supplied with a double jet as shown in Japanese Provisional Patent Publication No. 160128/1987 and a stirring rotation number of 500 to 1200 rpm/min.

Also, according to the method described in Japanese Provisional Patent Publication No. 138538/1985 as an example, desalting may be carried out at an optional time of silver halide grain growth.

During growth of the silver halide grains, a known silver halide solvent such as ammonia, thioether, thiourea, etc. can be permitted to exist.

The silver halide grains can be added with at least one metal ion selected from cadmium salts, zinc salts, lead salts, thallium salts, iridium salts (including complexes), rhodium salts (including complexes) and iron salts (including complexes) in the process of formation of grains and/or the process of growth to contain these metal elements internally of the grains and/or in the surface layer of the grains, and also can be placed in an appropriate reductive atmosphere, thereby to impart reduced sensitizing nucleus to the inner portion of the grains and/or to the surface of the grains.

The silver halide grains of the present invention can utilize the halogen substitution method in the course of formation of the grains.

As the halogen substitution method, it can be practiced by, for example, adding an aqueous solution comprising primarily an iodine compound (preferably potassium iodide), preferably an aqueous solution with a concentration of 10% or less at an optional time of the grain growth. In detail, it can be practiced according to the method as described in U.S. Pat. Nos. 2,592,250 and 4,075,020, Japanese Provisional Patent Publication No. 127549/1980, etc. At this time, for making the iodide distribution between grains smaller, it is desirable to add an aqueous solution of an iodine compound with $10^{-2}$ mole % or less over 10 minutes or longer.

In the preparation method of silver halide grains by supplying a silver salt aqueous solution and a halide aqueous solution with the double jet method, an aqueous solution of an iodide or a silver iodide containing solution with fine grain size may be also added at a great speed within the range which does not exceed the critical growth speed. The crystal sizes of silver iodide nuclei must be fine sizes to the extent but no new grain growth will occur on the basis of the nuclei.

The silver halide emulsion may have unnecessary soluble salts removed therefrom after completion of growth of silver halide grains. When said salts are to be removed, removal can be practiced on the basis of the method described in Research Disclosure (hereinafter abbreviated as "RD") No. 17643, item II.

The silver halide grains may be either grains in which latent images are formed primarily on the surface or grains in which they are formed primarily internally of the grains, but preferred is those formed primarily on the surface thereof. The silver halide grains may have sizes of 0.05 to 30 μm, preferably 0.1 to 20 μm.

The silver halide grains according to the present invention may be a normal crystal such as hexahedral, octahedral, dodecahedral or tetradecahedral, or a twinned crystal containing a plane crystal, but the normal crystal is preferred.

For the silver halide emulsion of the present invention, any of polydispersed emulsions with broad grain size distribution, monodispersed emulsions with narrow grain size distribution, etc. In practicing the present invention, it is preferred to use a monodispersed emulsion alone or a mixture thereof after sensitization.

In the present invention, the monodispersed silver halide emulsion may be preferably one with the silver halide weight contained within the grain size range of ±20% with the average particle size r as the center of 60% or more of the weight of total silver halide grains, more preferably 70% or more, further preferably 80% or more.

Here, the average grain size $\bar{r}$ is defined as the grain size ri at which the product $ni \times ri^3$ of the frequency ni of the grain having the grain size ri and $ri^3$ becomes the maximum (effective numerals 3 ciphers, with the maximum cipher numeral being rounded).

Here, the grain size ri is, in the case of a spherical silver halide grain, its diameter, and in the case of a grain with a shape other than sphere, the diameter of a circular image when its projected image is calculated to the circular image of the same area.

The grain size can be obtained by, for example, photographing said grains with magnification to 10,000 times to 50,000 times by an electron microscope, and measuring the diameter or the area when projected of the grain on the print (the number of the particles measured is made indiscriminately 1,000 or more).

A highly monodispersed emulsion particularly preferred in the present invention has 20% or less of breadth of distribution as defined by the following formula, more preferably 15% or less.

$$\frac{\text{Standard deviation}}{\text{Average grain size}} \times 100 = \text{Fluctuation coefficient (\%)}$$

Here, the average grain size and the standard deviation are to be determined from the above definition of ri. As the method for obtaining a monodispersed emulsion, it can be obtained by adding a solution of a water-soluble silver salt and a solution of a water-soluble halide into a gelatin solution containing seed grains according to the double jet method under control of pAg and pH. In determining the addition speed, reference can be made to Japanese Provisional Patent Publications No. 48521/1979 and No. 49938/1983.

As the further method for obtaining further highly monodispersed emulsion, the growth method in the presence of tetrazaindene disclosed in Japanese Provisional Patent Publication No. 122935/1985 can be applied.

The silver halide emulsion of the present invention can be chemically sensitized in conventional manner.

The silver halide emulsion of the present invention can be optically sensitized to a desired wavelength region by use of a dye known as the sensitizing dye in the field of photography. The sensitizing dye may be used either singly or as a combination of two or more kinds.

The silver halide emulsion can be added with antifoggants, stabilizers, etc. As the binder in said emulsion, gelatin may be advantageously used.

The emulsion layer and other hydrophilic colloid layers can be hardened, and also plasticizers, dispersions (latex) of water-insoluble or difficulty soluble synthetic polymers can be contained.

In the emulsion layer of the light-sensitive material for color photography, couplers are employed.

Further, it is possible to use colored couplers having the effect of color correction, competitive couplers and compounds releasing fragments through the coupling with the oxidized product of a developing agent, namely photographically useful fragments such as development accelerator, bleaching accelerator, developer, silver halide solvent, color controlling agent, film hardener, foggant, antifoggant, chemical sensitizer, spectral sensitizer and desensitizer.

The light-sensitive material can be provided with auxiliary layers such as filter layer, halation preventive layer, irradiation preventive layer, etc. In these layers and/or emulsion layers, dyes which are flowed out from the light-sensitive material or bleached during developing processing may be also contained.

In the light-sensitive material, formalin scavenger, fluorescent brightener, matting agent, lubricant, image stabilizer, surfactant, antifoggant, development accelerator, development retarder or bleaching accelerator can be added.

As the support, a paper laminated with polyethylene, etc., polyethylene terephthalate film, baryta paper, cellulose triacetate, etc. can be used.

For obtaining a dye image by use of the light-sensitive material of the present invention, conventionally known color photographic processing can be performed after exposure.

EXAMPLES

The present invention is described below in more detail by referring to Examples, but the effect based on the present invention is not limited thereto.

COMPARATIVE EXAMPLE 1

As comparative emulsions, core/shell type monodispersed emulsions Em-1 and Em-2 according to the method of Example 1 of Japanese Provisional Patent Publication No. 147727/1985 were prepared.

Preparation of Em-1

In one liter of water were added 30 g of gelatin, 8 g of potassium bromide and 120 ml of 0.1% 3,4-dimethyl-4-thiazolin-2-thione-methanol solution, and maintained at 75° C. in a vessel. To the mixture were added simultaneously under stirring 410 ml of an aqueous solution (liquid A) containing 250 g of silver nitride per liter and 400 ml of an aqueous solution (liquid B) containing 24 g of potassium iodide and 192 g of potassium bromide per liter over 30 minutes by maintaining pBr to 1.41 according to the double jet method.

The thus obtained silver halide grains had a size of 0.36 μm defined by the projected area size (hereinafter the same) and were octahedral silver iodobromide grains for internal core containing, on a prescription, 10 mole % of silver iodide.

The resulting octahedral silver iodobromide grains for internal core (28 g calculated on silver), 790 ml of water, 16 g of gelatin, and 80 ml of 0.1% 3,4-dimethyl-4-thiazolin-2-thione-methanol solution were mixed and maintained at 75° C. in a vessel. To the mixture were added simultaneously under stirring 670 ml of 0.94N silver nitride solution and 1.09N potassium bromide solution over 40 minutes by maintaining pBr to 1.41 according to the double jet method. The thus obtained silver halide grains were monodispersed octahedral grains having an average diameter of 0.65 μm and had a core/shell structure comprising an internal core and a shell of pure silver bromide.

Preparation of Em-2

In the substantially same manner as in Em-1 except for changing the ratio of potassium iodide and potassium bromide in the alkali halide solution and adjusting an amount of 3,4-dimethyl-4-thiazolin-2-thione-methanol solution so as to make uniform size in the preparation of the silver iodobromide grains for internal core, octahedral silver iodobromide grains for internal core, octahedral silver iodobromide grains for internal core containing, on a prescription, 40 mole % of silver iodide were obtained. Thereafter, in the same manner as in the preparation of Em-1, silver halide emulsion Em-2 containing silver halide grains of core/shell structure was obtained.

Comparative Example 2

As comparative emulsions, core/shell type monodispersed emulsions Em-3 and Em-4 according to the method of Example 1 of Japanese Provisional Patent Publication No. 35726/1985 were prepared.

Preparation of Em-3

In one liter of water were added 30 g of gelatin, 8 g of potassium bromide and 120 ml of 0.1% 3,4-dimethyl-4-thiazolin-2-thione-methanol solution, and maintained at 75° C. in a vessel. To the mixture were added simultaneously under stirring 800 ml of an aqueous solution (liquid A) containing 250 g of silver nitride per liter and 780 ml of an aqueous solution (liquid B) containing 5 g of potassium iodide and 206 g of potassium bromide per liter over 60 minutes by maintaining pBr to 1.41 according to the double jet method. The thus obtained silver halide grains had a size of 0.41 μm defined by the projected area size and were octahedral silver iodobromide grains for internal core containing, on a prescription, 2 mole % of silver iodide.

To the resulting octahedral silver iodobromide grains for internal core (34 g calculated on silver) was added 100 ml of potassium iodide aqueous solution containing 0.1 g of potassium iodide while thoroughly stirring over 10 minutes. Further, this silver iodobromide grains (34 g calculated on silver), 790 ml of water, 15 g of gelatin, and 80 ml of 0.1% 3,4-dimethyl-4-thiazolin-2-thione-methanol solution were mixed and maintained at 75° C. in a vessel. To the mixture were added simultaneously under stirring 650 ml of 0.64N silver nitride solution and 650 ml of 1.09N potassium bromide solution over 40 minutes by maintaining pBr to 1.41 according to the double jet method. The thus obtained silver halide grains were monodispersed octahedral grains having an average diameter of 0.65 μm.

Preparation of Em-4

In the same manner as in Em-1 except for replacing 100 ml of a potassium iodide solution with 100 ml of a potassium iodide solution containing 2.0 g of potassium iodide, monodispersed octahedral silver iodobromide grains were prepared.

EXAMPLE 1

A silver iodide emulsion containing 30.0 mole % of silver iodide was prepared by the double jet method under the conditions of 40° C., pH 8.0, pAg 8.0, and applied with water washing treatment to remove excessive salts. The grain thus obtained was found to have an average grain size of 0.27 μm, and a grain size distribution (standard deviation/average grain size) of 17%. This emulsion was formed into an emulsion containing silver corresponding to 1200 g as calculated on silver nitrate to provide a seed crystal emulsion (I). The amount of the seed grain emulsion (I) completed was 4,160 g.

Next, by use of the seed grain emulsion (I) and the five kinds of solutions shown below, monodispersed emulsions were prepared.

| | |
|---|---|
| **Solution A** | |
| Ossein gelatin | 40.5 g |
| 10% Methanolicc solution of sodium polyisopropylene-polyethyleneoxy-disuccinate | 9 ml |
| 28% Aqueous ammonia | 158 ml |
| 4-Hydroxy-6-methyl-1,3,3a,7-tetrazaindene | 0.5 g |
| with $H_2O$ | 10.8 liters |
| **Solution B-1** | |
| Ossein gelatin | 40.0 g |
| KBr | 999.6 g |
| KI | 929.6 g |
| 4-Hydroxy-6-methyl-1,3,3a,7-tetrazaindene | 4.2 g |
| with $H_2O$ | 4 liters |
| **Solution B-2** | |
| Ossein gelatin | 40.0 g |
| KBr | 1666.0 g |
| 4-Hydroxy-6-methyl-1,3,3a,7-tetrazaindene | 4.2 g |
| with $H_2O$ | 4 liters |
| **Solution C** | |
| $AgNO_3$ | 1563.4 g |
| Aqueous ammonia | equivalent |
| with $H_2O$ | 2.629 liters |

First, to Solution A maintained at 40° C. was added 402.5 g of the seed crystal emulsion (I), followed by stirring. Next, the mixture was adjusted to pAg 8 and pH 9 by use of 3.5N aqueous potassium bromide and 56% acetic acid. Then, Solution C was added with an initial flow amount of 8 cc/min in proportion to the increase of the surface area of the surface of silver halide grains over 95 minutes. During the addition, simultaneously with initiation of the addition of Solution C, Solution B-1 was added by lowering the flow amount continuously from initiation of addition to 75 minutes so that the initial flow amount was 8 cc/min to the final flow amount of 0 cc/min, while Solution B-2 was added with an initial flow amount of 0 cc/min so that the combined flow amounts of Solutions B-1 and B-2 became the same flow amount of Solution C during the addition. pAg during growth of the silver halide grains was maintained at 8 from initiation of growth to 55 minutes, then varied continuously to 10.2 to 80 minutes, and thereafter adjusted with 3.5N aqueous potassium bromide constantly to 10.2 until completion of growth. Similarly, pH was maintained at 9 from initiation of growth to 75 minutes, and then varied continuously to 8 until completion of growth. After completion of the addition, pH was adjusted to 6.0 and pAg 10.3, and in order to remove excessive salts, precipitating desalting was effected by use of an aqueous Demol (produced by Kao Atlas Co.) and an aqueous magnesium sulfate, and an emulsion of pH 5.85 was obtained at pAg 7.73 at 40° C. Emulsion is an emulsion containing octahedral grains having a grain size of 0.65 μm and a grain size distribution of 13%. This is called Em-5.

EXAMPLE 2

The preparation method was basically the same as in Example 1, and except for initiating addition of Solution B-1 with an initial flow amount of 8 cc/min and varying continuously the flow amount respectively to 0 cc/min to 80 minutes from initiation of addition and completion of growth of silver halide grains, respectively, Em-6 and Em-7 were prepared respectively in the same manner as in Example 1. Em-6 and Em-7 had grain size distribution of 14 and 14.5%, respectively, and crystal phases were both octahedral.

For each of Em-1, Em-2, Em-3, Em-4, Em-5, Em-6 and Em-7 shown in Comparative examples 1 and 2 as well as Examples 1 and 2, the above ultra-microtome was used and each grain cross-section of 20 grains of each silver halide was subjected to XMA measurement of from the center portion of grain to the grain surface. As the result, it was found that a maximum point of the silver halide content (defined as a distance $l_1$ from the center of the grain) and a minimum point of the silver halide content (defined as a distance $l_2$ from the center of the grain) are present in all of grains in the each emulsiion, and the results measured are shown in Table 1. The silver halide contents of each grains in the each emulsion are monotonously reduced from the maximum point of the silver halide content to the minimum point of the silver halide content. Here, $l_0$ means a distance from the center of the grain to the outermost surface thereof. The values shown in Table 1 were an average value of the maximum value of the 20 grains of the measured silver halide. Also, the silver iodide content of the outermost surface of the grains of each emulsion measured by X-ray photoelectric spectroscopy are also shown therein.

TABLE 1

| Emulsion No. | Maximum point of silver iodide content | | Minimum point of silver iodide content | | $(l_2 - l_1)/l_0 \times 100$ (%) | AgI content at outermost surface of grain (mole %) |
|---|---|---|---|---|---|---|
| | $l_1$ (μm) | Content of AgI (mole %) | $l_2$ (μm) | Content of AgI (mole %) | | |
| Em-1 (Comparative) | 0.17 | 9.8 | 0.19 | 0 | 6.2 | 0 |

TABLE 1-continued

| Emulsion No. | Maximum point of silver iodide content $l_1$ (μm) | Content of AgI (mole %) | Minimum point of silver iodide content $l_2$ (μm) | Content of AgI (mole %) | $(l_2 - l_1)/l_0 \times 100$ (%) | AgI content at outermost surface of grain (mole %) |
|---|---|---|---|---|---|---|
| Em-2 (Comparative) | 0.16 | 39 | 0.21 | 0 | 15.4 | 0 |
| Em-3 (Comparative) | 0.205 | 5.2 | 0.215 | 0 | 3.1 | 0 |
| Em-4 (Comparative) | 0.205 | 38 | 0.22 | 0 | 6.2 | 0 |
| Em-5 (This invention) | 0.15 | 38 | 0.265 | 0 | 35.4 | 0 |
| Em-6 (This invention) | 0.15 | 38 | 0.295 | 0 | 44.6 | 0 |
| Em-7 (This invention) | 0.15 | 38 | 0.325 | 1 | 53.8 | 1 |

EXAMPLE 4

The emulsions Em-1 to Em-7 shown in Comparative examples 1 and 2, and Examples 1 and 2 were chemically aged in the presence of sodium thiosulfate, chloroauric acid and ammonium thiocyanate, followed by addition of a sensitizing dye as described below and addition of 4-hydroxy-6-methyl-1,3,3a,7-tetrazaindene as the stabilizer. By use of these emulsions, on a triacetyl cellulose film support were formed successively the respective layers having the compositions shown below from the support side to prepare multi-layer color photographic element samples.

In all of Examples shown below, the amounts added in the light-sensitive silver halide photographic material are those per 1 $m^2$ unless otherwise specifically noted. Silver halide and colloidal silver were shown as calculated on silver.

On a triacetyl cellulose film support, the respective layers having the compositions as shown below were formed successively from the support side to prepare a multilayer color photographic element sample 1.

Sample 1 (Comparative)

Layer 1: Halation preventive layer (HC-1)
Gelatin layer containing black colloid silver
Layer 2: Intermediate layer (IL)
Gelatin layer containing an emulsified dispersion of 2,5-di-t-octylhydroquinone
Layer 3: Low sensitivity red-sensitive silver halide emulsion layer (RL-1)

| | |
|---|---|
| Average grain size (r): comprising AgBrI containing 6 mole % of AgI | 0.38 μm |
| Monodispersed emulsion (Emulsion I) amount of silver coated: | 1.8 g/$m^2$ |
| Sensitizing dye I | $5.0 \times 10^{-4}$ mole per 1 mole of silver |
| Sensitizing dye II | $0.8 \times 10^{-4}$ mole per 1 mole of silver |
| Cyan coupler (C-1) | 0.085 mole per 1 mole of silver |
| Colored cyan coupler (CC-1) | 0.005 mole per 1 mole of silver |
| DIR compound (D-1) | 0.0015 mole per 1 mole of silver |
| DIR compound (D-2) | 0.002 mole per 1 mole of silver |

Layer 4: High sensitivity red-sensitive silver halide emulsion layer (RH-1)

| | |
|---|---|
| Average grain size (r): | 0.65 μm |
| Amount of silver coated: | 1.3 g/$m^2$ |

-continued

Sample 1 (Comparative)

| | |
|---|---|
| Sensitizing dye I | $2.5 \times 10^{-4}$ mole per 1 mole of silver |
| Sensitizing dye II | $0.8 \times 10^{-4}$ mole per 1 mole of silver |
| Cyan coupler (C-2) | 0.007 mole per 1 mole of silver |
| Colored cyan coupler (CC-1) | 0.0015 mole per 1 mole of silver |
| DIR compound (D-2) | 0.001 mole per 1 mole of silver |

Layer 5: Intermediate layer (IL)
the same as Layer 2, gelatin layer
Layer 6: Low sensitivity green-sensitive silver halide emulsion (GL-1)

| | |
|---|---|
| Emulsion-I . . . amount of silver coated: | 1.5 g/$m^2$ |
| Sensitizing dye III | $2.0 \times 10^{-4}$ mole per 1 mole of silver |
| Sensitizing dye IV | $1.0 \times 10^{-4}$ mole per 1 mole of silver |
| Magenta coupler (M-1) | 0.090 mole per 1 mole of silver |
| Colored magenta coupler (CM-1) | 0.004 mole per 1 mole of silver |
| DIR compound (D-1) | 0.0010 mole per 1 mole of silver |
| DIR compound (D-3) | 0.0030 mole per 1 mole of silver |

Layer 7: High sensitivity green-sensitive silver halide emulsion layer (GH-1)

| | |
|---|---|
| Amount of silver coated: | 1.4 g/$m^2$ |
| Sensitizing dye III | $1.2 \times 10^{-4}$ mole per 1 mole of silver |
| Sensitizing dye IV | $0.8 \times 10^{-4}$ mole per 1 mole of silver |
| Magenta coupler (M-1) | 0.015 mole per 1 mole of silver |
| Colored magenta coupler (CM-1) | 0.002 mole per 1 mole of silver |
| DIR compound (D-3) | 0.0010 mole per 1 mole of silver |

Layer 8: Yellow filter layer (YC-1)
Gelatin layer containing yellow colloid silver and an emulsified dispersion of 2,5-di-t-octylhydroquinone
Layer 9: Low sensitivity blue-sensitive silver halide emulsion layer (BL-1)

| | |
|---|---|
| Average grain size (r): | 0.38 μm, comprising |
| AgBrI containing 6.0 mole % of AgI | |
| Monodispersed emulsion (Emulsion I) amount of silver coated: | 0.9 g/$m^2$ |
| Yellow coupler (Y-1) | 0.29 mole per 1 mole of silver |

Layer 10: High sensitivity blue-sensitive silver halide emulsion layer (BH-1)

| | |
|---|---|
| Amount of silver coated: | 0.5 g/$m^2$ |
| Sensitizing dye V | $1.0 \times 10^{-4}$ per 1 mole of silver |
| Yellow coupler (Y-1) | 0.08 mole per 1 mole of silver |

-continued

| Sample 1 (Comparative) | |
|---|---|
| DIR compound (D-2) | 0.0030 mole per 1 mole of silver |
| Layer 11: First protective layer (Pro-1) | |
| Silver iodobromide (containing 7 mole % of AgI 7, average grain diameter: 0.07 μm) Amount of silver coated: | 0.5 g/m² |
| Gelatin layer containing UV-ray absorbers UV-1 and UV-2 | |
| Layer 12: Second protective layer (Pro-2) | |
| Gelatin layer containing polymethyl methacrylate particles (diameter 1.5 μm) and formalin scavenger (HS-1) | |

In the respective layers, in addition to the above compositions, hardening agents (H-1) and (H-2) and surfactants were added.

The compounds contained in the respective layers of Sample 1 are as shown below.

Sensitizing dye I: Anhydro-5,5-dichloro-9-ethyl-3,3'-di-(3-sulfopropyl)thiacarbocyanie hydroxide Sensitizing dye II: Anhydro-9-ethyl-3,3'-di-(3-sulfopropyl)-4,5,4',5'-dibenzothiacarbocyaninehydroxide Sensitizing dye III: Anhydro-5,5'-diphenyl-9-ethyl-3,3'-di(3-sulfopropyl)oxacarbocyaninehydroxide Sensitizing dye IV: Anhydro-9-ethyl-3,3'-di-(3-sulfopropyl)-5,6,5',6'-dibenzothiacarbocyaninehydroxide Sensitizing dye V: Anhydro-3,3'-di-(3-sulfopropyl)-4,5-benzo-5'-methoxythiacyanineanhydroxide

C-1

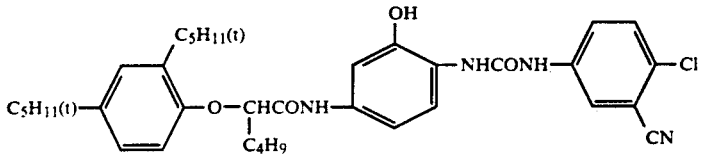

C-2

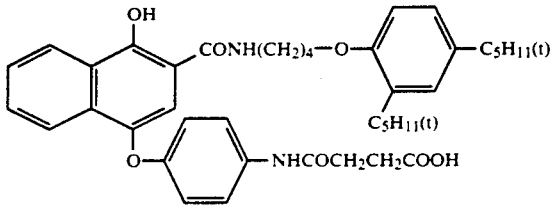

C-3

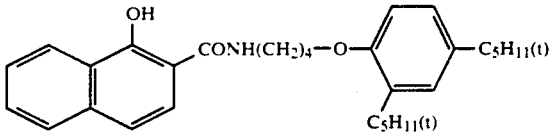

CC-1

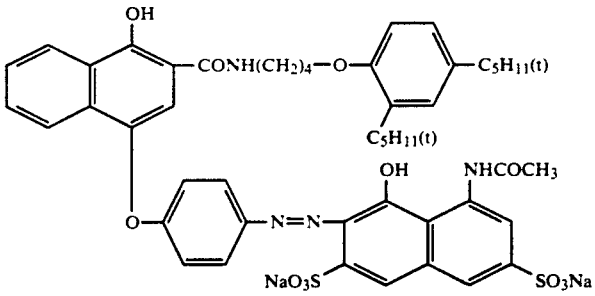

D-1

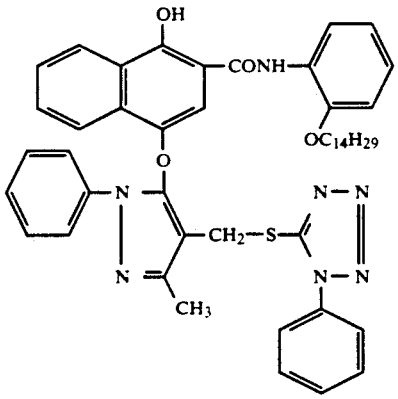

-continued
D-2
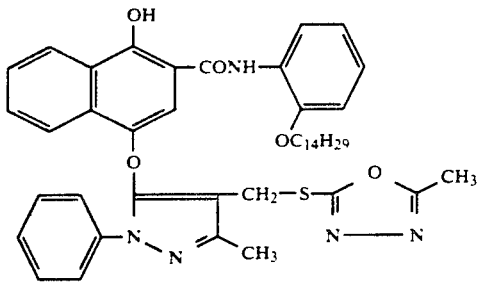
D-3
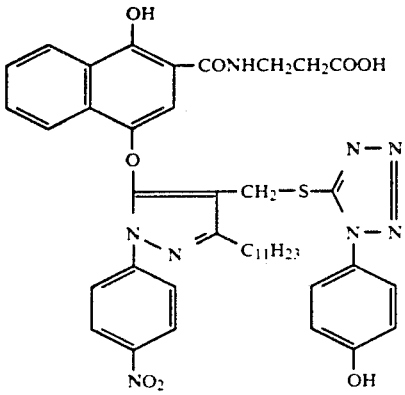
M-1
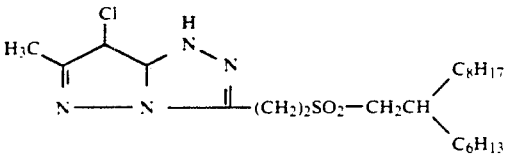
CM-1
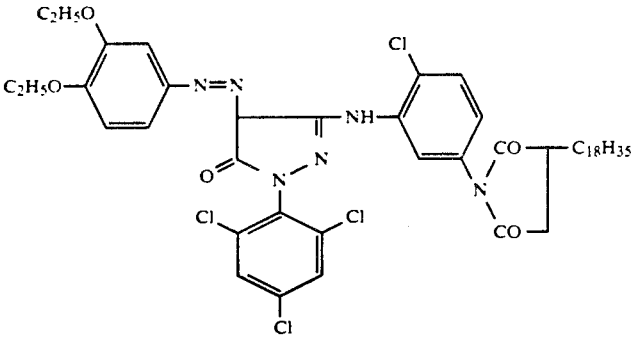
Y-1
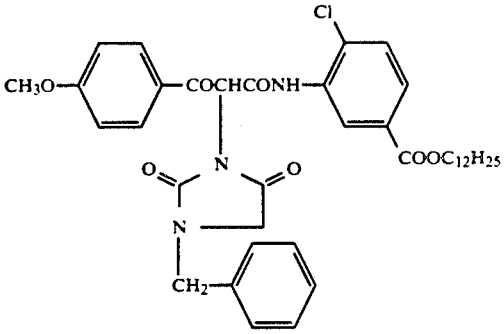

-continued

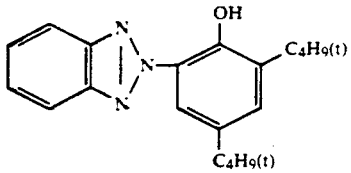

UV-1

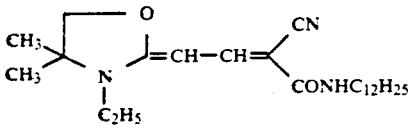

UV-2

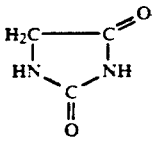

HS-1

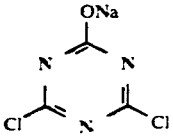

H-1

$((CH_2{=}CHSO_2CH_2)_3CCH_2SO_2(CH_2)_2)_2N(CH_2)_2SO_3K$

H-2

Next, Samples 2 to 7 were made by use of Em-2 to Em-7 in place of the silver halide emulsion Em-1 in Layer 4, Layer 7 and Layer 10 in Sample 1.

Two parts of the respective Samples No. 1 to No. 7 thus made were prepared, and one part was subjected to wedge exposure by use of white light, followed by the developing processing shown below, while the other part after scratching scar was inflicted by a scratching meter thereon, was subjected to the following developing processing without exposure.

| Processing step (38° C.) | |
|---|---|
| Color developing | 3 min 15 sec |
| Bleaching | 6 min 30 sec |
| Water washing | 3 min 15 sec |
| Fixing | 6 min 30 sec |
| Water washing | 3 min 15 sec |
| Stabilizing | 1 min 30 sec |
| Drying | |

The processing liquors used in the respective processing steps had the compositions as shown below.

| (Color developing solution) | |
|---|---|
| 4-Amino-3-methyl-N-ethyl-N-(β-hydroxyethyl)aniline sulfate | 4.75 g |
| Anhydrous sodium sulfite | 4.25 g |
| Hydroxylamine · ½ sulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| Made up to one liter with addition of water, and adjusted to pH = 6.0 by use of aqueous ammonia. | |
| (Bleaching solution) | |
| Iron ammonium ethylenediamine-tetraacetate | 100 g |
| Diammonium ethylenediaminetetraacetate | 10.0 g |
| Ammonium bromide | 150.0 g |

-continued

| | |
|---|---|
| Glatial acetic acid | 10.0 ml |
| Made up to one liter with addition of water, and adjusted to pH = 6.0 by use of aqueous ammonia. | |
| (Fixing solution) | |
| Ammonium thiosulfate | 175.0 g |
| Anhydrous sodium sulfite | 8.5 g |
| Sodium metasulfite | 2.3 g |
| Made up to one liter with addition of water, and adjusted to pH = 6.0 by use of acetic acid. | |
| (Stabilizing solution) | |
| Formalin (37% aqueous solution) | 1.5 ml |
| Konidax (produced by Konica Corporation) | 7.5 ml |
| Made up to one liter with addition of water. | |

For each sample obtained, by use of blue light (B), green light (G) and red light (R), relative sensitivity (S) and pressure fog (ΔD) were measured. The results are shown in Table 2 to Table 4.

Relative sensitivity (S) is a relative value of reciprocal exposure which gives a fog density of +0.1, and is shown in terms of the value of relatively to each B, R, G sensitivity of Sample No. 1 as being 100.

The pressure fog value (ΔD) is shown in terms of relative value of fluctuation of the density value obtained when a microdensitometer is scanned across the scratched scar.

This value also indicates greater effect as the value is smaller.

TABLE 2

| Sample No. | Emulsions in Layers 4, 7 and 10 | Relative sensitivity of blue-sensitive layer | Pressure fog of blue-sensitivity layer |
|---|---|---|---|
| 1 (Comparative) | Em-1 | 100 | 100 |
| 2 (Comparative) | Em-2 | 75 | 90 |
| 3 (Comparative) | Em-3 | 100 | 110 |

TABLE 2-continued

| Sample No. | Emulsions in Layers 4, 7 and 10 | Relative sensitivity of blue-sensitive layer | Pressure fog of blue-sensitivity layer |
|---|---|---|---|
| 4 (Comparative) | Em-4 | 85 | 105 |
| 5 (This invention) | Em-5 | 125 | 78 |
| 6 (This invention) | Em-6 | 130 | 76 |
| 7 (This invention) | Em-7 | 125 | 80 |

TABLE 3

| Sample No. | Emulsions in Layers 4, 7 and 10 | Relative sensitivity of green-sensitive layer | Pressure fog of green-sensitivity layer |
|---|---|---|---|
| 1 (Comparative) | Em-1 | 100 | 100 |
| 2 (Comparative) | Em-2 | 77 | 95 |
| 3 (Comparative) | Em-3 | 95 | 112 |
| 4 (Comparative) | Em-4 | 80 | 102 |
| 5 (This invention) | Em-5 | 130 | 78 |
| 6 (This invention) | Em-6 | 135 | 77 |
| 7 (This invention) | Em-7 | 125 | 82 |

TABLE 4

| Sample No. | Emulsions in Layers 4, 7 and 10 | Relative sensitivity of red-sensitive layer | Pressure fog of red-sensitivity layer |
|---|---|---|---|
| 1 (Comparative) | Em-1 | 100 | 100 |
| 2 (Comparative) | Em-2 | 81 | 94 |
| 3 (Comparative) | Em-3 | 95 | 110 |
| 4 (Comparative) | Em-4 | 80 | 104 |
| 5 (This invention) | Em-5 | 130 | 77 |
| 6 (This invention) | Em-6 | 140 | 76 |
| 7 (This invention) | Em-7 | 130 | 82 |

From the results shown in Tables 2, 3 and 4, it can be understood that the Samples 5, 6 and 7 containing the silver halide grains according to the present invention are excellent in pressure fog characteristic.

We claim:

1. A light-sensitive silver halide photographic material having at least one silver halide emulsion layer containing silver halide crystal grains in which the improvement comprises at least one of said silver halide emulsion layer contains non-core/shell silver halide crystal grains which satisfy the following conditions of:

(1) composed substantially of silver iodobromide, (2) having a maximum point of a silver iodide content at 67% or less of a distance from the center of the silver halide grain relative to a distance ($l_0$) from the center of the silver halide grain to the outermost surface thereof, (3) having a minimum point of the silver iodide content at 58% or more of the distance form the center of the silver halide grain relative to $l_0$, (4) substantially continuously reduced in the silver iodide content from the maximum point of the silver iodide content to the minimum point thereof, and (5) satisfies the following formula:

$$\frac{l_2 - l_1}{l_0} \times 100 \geqq 35.4$$

wherein $l_0$ has the same meaning as defined above, $l_1$ represents a distance of the maximum point of the silver iodide content from the center of the silver halide grain and $l_2$ represents a distance of the minimum point of the silver iodide content from the center of the silver halide grain.

2. A light-sensitive silver halide photographic material according to claim 1, wherein the silver iodide content in the outermost surface layer of the silver halide grain is 20 mole % or less.

3. A light-senstive silver halide photographic material according to claim 2, wherein said silver iodide content in the outermost surface layer of the silver halide grain is 10 mole % or less.

4. A light-sensitive silver halide photographic material according to claim 3, wherein said silver iodide content in the outermost surface layer of the silver halide grain is 6 mole % or less.

5. A light-sensitive silver halide photographic material according to claim 4, wherein said silver iodide content in the outermost surface layer of said grain is 0 mole %.

6. A light-sensitive silver halide photographic material according to claim 1, wherein the inner structure of the silver halide grain in which the silver iodide content is substantially continuously reduced is a structure in which the silver iodide content is reduced linearly from a specific point in the inner portion toward a specific point of the surface along a curve having no maximum or minimum.

7. A light-sensitive silver halide photographic material according to claim 1, wherein the inner structure of the silver halide grain in which the silver iodide content is substantially continuously reduced is a structure in which the silver iodide content is reduced along a curve having one or a plural number of maximum value or minimum value.

8. A light-sensitive silver halide photographic material according to claim 1, wherein the maximum point of silver iodide content is present at 58% or less of the distance from the center of the silver halide grain relative to the distance from the center of the silver halide grain to the outermost surface thereof.

9. A light-sensitive silver halide photographic material according to claim 8, wherein the maximum point of silver iodide content is present at 46% or less.

10. A light-sensitive silver halide photographic material according to claim 9, wherein the maximum point of silver iodide content is present at 37% or less.

11. A light-sensitive silver halide photographic material according to claim 1, wherein the minimum content of silver iodide content is present at 67% or more of the distance from the center of the silver halide grain relative to the distance from the center of the silver halide grain to the outermost surface thereof.

12. A light-sensitive silver halide photographic material according to claim 11, wherein the minimum content of silver iodide content is present at 78% or more.

13. A light-sensitive silver halide photographic material according to claim 1, wherein the silver halide crystal grains satisfying the conditions (1) to (5) are contained in the silver halide emulsion layer with an amount of 10% by weight or more.

14. A light-sensitive silver halide photographic material according to claim 13, wherein said silver halide crystal grains are contained with an amount of 50% by weight or more.

15. A light-sensitive silver halide photographic material according to claim 14, wherein said silver halide crystal grains are contained with an amount of 60 to 100% by weight.

16. A light-sensitive silver halide photographic material according to claim 1, wherein a silver iodide content in the whole grains of the silver halide emulsion is 30 mole % or less.

17. A light-sensitive silver halide photographic material according to claim 16, wherein said silver iodide content in the whole grains of the silver halide emulsion is 1 to 20 mole %.

18. A light-sensitive silver halide photographic material according to claim 17, wherein said silver iodide content in the whole grains of the silver halide emulsion is 3 to 15 mole %.

19. A light-sensitive silver halide photographic material according to claim 4, wherein the maximum point of silver iodide content is present at 58% or less of the distance from the center of the silver halide grain relative to the distance from the center of the silver halide grain to the outermost surface thereof.

20. A light-sensitive silver halide photographic material according to claim 19, wherein the minimum content of silver iodide content is present at 67% or more of the distance from the center of the silver halide grain relative to the distance from the center of the silver halide grain to the outermost surface thereof.

21. A light-sensitive silver halide photographic material according to claim 20, wherein the minimum point of silver iodide content is present at 37% or less and the minimum content of silver iodide is present at 78% or more.

22. A light-sensitive silver halide photographic material according to claim 21, wherein the silver halide crystal grains satisfying the conditions (1) to (5) are contained in the silver halide emulsion layer with an amount of 50% by weight or more.

23. A light-sensitive silver halide photographic material according to claim 22, wherein a silver iodide content in the whole grains of the silver halide emulsion is 3 to 15 mole %.

24. A light-sensitive silver halide photographic material according to claim 19, wherein the inner structure of the silver halide grain in which the silver iodide content is substantially monotonously reduced is a structure in which the silver iodide content is reduced linearly from a specific point in the inner portion toward a specific point of the surface along a curve having no maximum or minimum.

25. A light-sensitive silver halide photographic material according to claim 24, wherein the minimum content of silver iodide content is present at 67% or more of the distance from the center of the silver halide grain relative to the distance from the center of the silver halide grain to the outermost surface thereof.

26. A light-sensitive silver halide photographic material according to claim 25, wherein said silver halide crystal grains are contained with an amount of 50% by weight or more.

27. A light-sensitive silver halide photographic material according to claim 26, wherein said silver iodide content in the whole grains of the silver halide emulsion is 1 to 20 mole %.

28. A light-sensitive silver halide photographic material according to claim 21, wherein said silver halide crystal grains are contained with an amount of 50% by weight or more.

29. A light-sensitive silver halide photographic material according to claim 28, wherein said silver iodide content in the whole grains of the silver halide emulsion is 3 to 15 mole %.

30. The light-sensitive silver halide photographic material according to claim 1, wherein silver iodide is contained substantially through the non-core/shell silver halide crystal grains.

* * * * *